United States Patent [19]

Pierce

[11] Patent Number: 4,821,804

[45] Date of Patent: Apr. 18, 1989

[54] COMPOSITE SUPPORT COLUMN ASSEMBLY FOR OFFSHORE DRILLING AND PRODUCTION PLATFORMS

[76] Inventor: Robert H. Pierce, Box 590694, Houston, Tex. 77259-0694

[21] Appl. No.: 186,752

[22] Filed: Apr. 26, 1988

Related U.S. Application Data

[63] Continuation of Ser. No. 716,576, Mar. 27, 1985, abandoned.

[51] Int. Cl.[4] ..... E21B 7/12

[52] U.S. Cl. ..... 166/367; 114/230; 405/195; 405/196

[58] Field of Search ..... 138/109, 130, 154

[56] References Cited

U.S. PATENT DOCUMENTS

| | | | |
|---|---|---|---|
| 2,953,904 | 9/1960 | Christenson | 405/196 |
| 3,424,253 | 1/1969 | Triplett | 175/7 |
| 4,023,835 | 5/1977 | Ewing et al. | 156/173 X |
| 4,127,003 | 11/1978 | Vilain | 405/210 X |
| 4,188,157 | 2/1980 | Vigander | 405/210 |
| 4,231,436 | 11/1980 | Waller | 175/7 |
| 4,351,260 | 9/1982 | Tuson et al. | 114/230 |
| 4,561,803 | 12/1985 | Campo et al. | 175/9 X |
| 4,589,801 | 5/1986 | Salama | 156/173 X |
| 4,602,586 | 7/1986 | Ortloff | 114/230 |
| 4,634,314 | 1/1987 | Pierce | 166/367 X |

FOREIGN PATENT DOCUMENTS

| | | | |
|---|---|---|---|
| 2098815 | 7/1970 | France | 405/224 |

OTHER PUBLICATIONS

*Modern Plastics Encyclopedia* "Carbon", H. F. Volk Oct. 1983, Vol. 60, No. 10A, pp. 120–121.

*Primary Examiner*—Jerome W. Massie, IV
*Assistant Examiner*—David J. Bagnell
*Attorney, Agent, or Firm*—Hubbard, Thurman, Turner & Tucker

[57] ABSTRACT

An offshore fixed platform support column assembly for deep water hydrocarbon development and production systems comprises an elongated cylindrical composite column which extends upward from a base assembly made up of a central cylindrical reinforced concrete caisson and one or more clusters of cylindrical reinforced concrete storage tanks to a point just below the sea surface. The column is made up of members having wound filament-resin composite cylindrical walls coupled end to end by coupling members which transmit tensile, bending and compressive loads between a platform structure supported at the upper end of the column assembly and the base assembly. The column members may include outer reinforced plastic shells forming buoyancy chambers which are filled with an expanded foam plastic buoyancy material. The column members may include reinforced concrete inner cylinder liners for transferring the static weight of the platform assembly to the seabed through the assembly of the central caisson and the anchor members. In one embodiment the column assembly terminates at its upper end several hundred feet below the surface and is adapted to anchor a submersible vessel by anchor cables which descend through corner support columns of the vessel and are secured to the upper end of the column assembly. The anchor cables may be winched to draw the vessel below the sea surface out of wind and wave action.

12 Claims, 6 Drawing Sheets

COMPOSITE SUPPORT COLUMN ASSEMBLY FOR OFFSHORE DRILLING AND PRODUCTION PLATFORMS

This application is a continuation, of application Ser. No. 716,576, filed Mar. 27, 1985 now abandoned.

BACKGROUND OF THE INVENTION

1. Field of the Invention

The present invention pertains to a support structure for offshore deepwater drilling and production platforms and the like characterized by a segmented filament wound composite support column connected to a gravity type base or anchor assembly.

2. Background

The continued development of offshore subsea wells for the recovery of hydrocarbon fluids has resulted in the encounter of several problems in the development of suitable structures for performing drilling and completion operations from above the surface of the sea and for producing fluids from the completed wells. The development of subsea production zones in waters 1000 feet deep or more has made it particularly desirable to consider the use of so-called fixed platform systems wherein a drilling or the sea on a structure which is fixed to or is resting on the sea bed. Although various types of deep water structural concepts have been considered, including guided towers, tension leg platforms and semi submersible vessel based floating platform systems, all of these concepts have certain disadvantages.

Many of the disadvantages of the aforementioned types of structures can be overcome with single or multiple, generally vertical column type structures which are adapted to be supported on the seabed and extend to or above the water surface. However, conventional construction techniques and engineering materials present certain problems for structures which may be required to be of a vertical height of from 1000 feet to as much as 3500 feet. For example, the foundation requirements for structures made solely of steel, concrete or combinations of both materials, are substantial and may require unreasonably large base structures to reduce the unit pressure on the seabed resulting from the weight of the column structure itself. With the latter supporting technique there is also always the possibility of the structure shifting or settling over a long period of time. Moreover, the problems associated with structural fatigue and corrosion using conventional engineering metals, the use of which has been previously thought necessary to make such a structure economically feasible, also appear to preclude the construction of so-called gravity base vertical column structures utilizing steel, for example, or reinforced concrete alone or in combination with each other.

It has been determined that there are several parameters which desirably should be satisfied when providing a deep water fixed platform structure of the type discussed herein. Primary considerations include the provision of a structure which is sufficiently stiff to withstand wave loads without incurring a list of more than about 8° off horizontal. Moreover the structure should be able to withstand dynamic cyclic wind and wave induced loads and be resistant to fatigue failure caused by such loading. Such a structure should be resistant to corrosion caused by sea water and other environmental hazards and, of course, ease of fabrication must be considered to make the structure economically feasible. Although reinforced concrete structures have been given consideration with a view to satisfying the above-mentioned criteria, such types of structures are not attractive from the standpoint of weight and fabrication or assembly requirements.

However, in pursuing the present invention, it has been determined that a structure supported on the seabed may be provided which is characterized by a single, segmented column assembly extending to or above the surface and which is fabricated primarily from a carbon or boron fiber-resin matrix having a tensile strength greater than and a modulus of elasticity approximately equal to or greater than alloy steel. Such a structure typically may have a density no more than 25% to 30% of that of a comparable steel structure. A deep water platform support structure is also contemplated in accordance with the present invention utilizing carbon, boron or a similar filament in a resin matrix to provide a composite shell disposed around a reinforced concrete cylinder which may serve as a mandrel on which the outer shell is constructed and is adapted to support particularly heavy static loads. The advantages and unique aspects of the present invention will be further evident to those skilled in the art upon reading the following summary and detailed description of the invention.

SUMMARY OF THE INVENTION

The present invention provides a deep water support structure for a well drilling and production platform and the like which is characterized by a generally cylindrical support column connected to a base structure which is preferably self anchoring to the seabed. In accordance with an important aspect of the invention, a deep water platform support or anchoring structure is provided characterized by a single cylindrical, segmented support column made up of a plurality of column members which are fabricated from a composite characterized by helically wound, transverse and/or longitudinally extending filaments of carbon, boron, aramid and combinations of these as well as other materials embedded in a resin matrix and to provide a structure which may have virtually neutral buoyancy or even net positive buoyancy. The column is also adapted to be supported by a suitable anchoring structure which may be of conventional construction.

In accordance with another aspect of the invention, the support column may include a cylindrical core portion made of reinforced concrete which may serve as a mandrel for the construction of the outer shell of wound filaments of one of the above mentioned fibers in a resin matrix to provide a composite structure characterized by an outer shell of a fiber-resin construction and a reinforced concrete inner shell or core. Such a composite structure has superior stiffness and strength in compression to support relatively large platform structures at the water surface.

In accordance with yet another aspect of the present invention, a support structure is provided comprising a column assembly having a reinforced gravity base for anchoring the column to the seabed and wherein the column provides anchor means for a floating platform which is connected to the column structure by a plurality of anchor cables and whereby the platform may be submerged while remaining connected to the column during adverse weather and heavy seas and like.

In accordance with still further aspects of the present invention, there is provided a so-called fixed platform support structure for an offshore well development and production platform which is characterized by a support column which may be designed to have virtually neutral or positive buoyancy to reduce the static loading on an anchor portion of the column structure and to reduce the static compressive load on at least part of the column structure itself. A platform support system is provided which does not require pressurized floatation elements and a support column is provided which does not require any seabed piling or separate catenary or guyed type mooring elements. Since the structure is supported on the seabed, there is no vertical movement of the platform nor is there is any requirement to disconnect the structure from the wellheads or any other conduits or risers during heavy sea conditions as is required for conventional floating platform systems. The fixed platform structure also eliminates the requirements for complicated joints in the riser system.

The present invention includes a hollow, non pressurized central support column and central anchoring caisson member which presents relatively low resistance to current and wind induced wave action and all of the riser elements are protected and supported within the column structure itself. Only limited horizontal movement of a platform supported by the column is possible under the severest sea conditions.

In accordance with further advantages of the present invention, a structure is provided which is constructed, assembled and positioned on the seabed at the desired site in accordance with an improved method and enjoys all of the benefits of the safety and reliability of a fixed platform structure as compared with floating or semi submersible platform structures. The unique column construction and the single support column configuration has a high resistance to seismic forces and the structure is reusable at other drilling or production sites.

In accordance with still further aspects of the present invention, there is provided a fixed platform type support structure for an offshore drilling and production platform wherein a considerable amount of fluid storage capacity is provided in the anchor or base portion of the structure. The support column is particularly adapted to provide a mooring system for a tank ship whereby the ship may pivot or "weathervane" with respect to the support column. The support column also includes a swivel assembly which may be adapted to include a gas flare arm projecting opposite from a ship mooring boom for the mooring system.

The above mentioned features and advantages of the present invention, together with other superior aspects thereof, will be appreciated by those skilled in the art upon reading the following detailed description in conjunction with the drawing.

DESCRIPTION OF THE PREFERRED EMBODIMENTS

Figure 1:
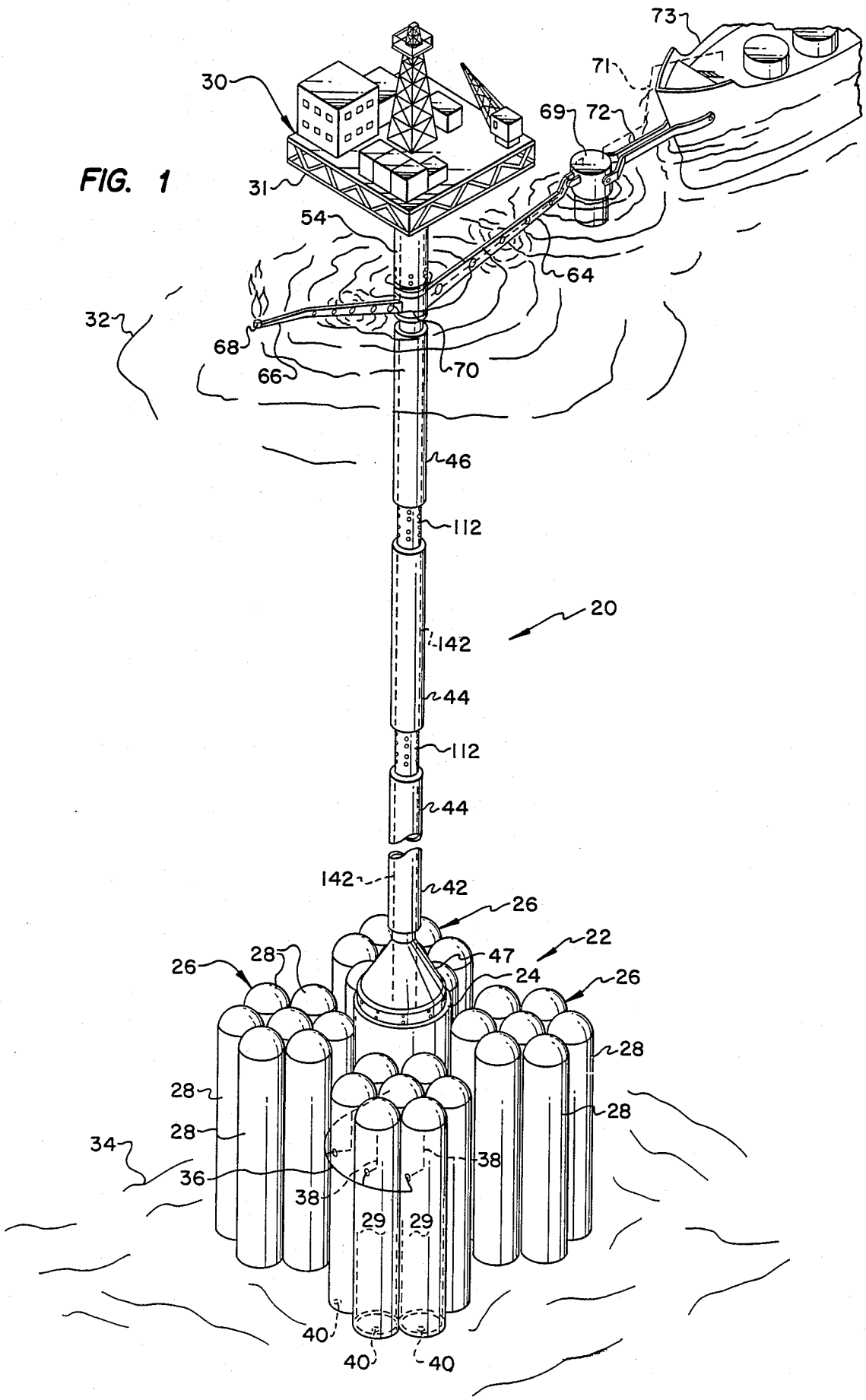
FIG. 1 is a perspective view of an offshore composite support column and platform assembly in accordance with the present invention.

In the description which follows, like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1, a fixed platform support column assembly is illustrated and generally designated by the numeral 20. The support column assembly includes a base section 22 characterized by a central, generally cylindrical caisson member 24 and plural clusters 26 of elongated generally cylindrical combination storage vessels and anchor members 28. The anchor members 28 are suitably secured to each other in the respective clusters 26 which in turn are suitably secured to the central caisson member 24. The members 24 and 28 are preferably formed of reinforced concrete. In a typical support column assembly in accordance with the present invention adapted for anchoring in water depths ranging from 2,000 to 3,000 feet, the anchor members 28 may typically have an outside diameter of about 120 feet and an overall height of 750 feet. The central caisson member 24 typically would have an outside diameter of 225 feet and an overall height of about 960 feet.

Wall thicknesses of the members 24 and 28 will be sufficient to provide adequate stability for the support column assembly including a well drilling and production platform, generally designated by the numeral 30, supported at the upper end of the column assembly and above the surface 32 of the sea. The mass or wall thickness of the members 24 and 28 should be sufficient to provide not more than about 17.0 pounds per sq. ft. of bearing pressure on the seabed 34. Accordingly, for the abovementioned dimensions and for supporting a platform 30 having a weight of about 30,000 tons, the anchor members 28 may have a wall thickness in the range of about 25 to 40 feet leaving an interior chamber 29 in each of the anchor members 28 of a diameter of approximately no less than 40 feet.

The chambers 29 may be used for the storage of fluids produced at the platform 30 and which may be conducted between the platform 30 and the chambers through a suitable system of conduits 36 and 38 as indicated by way of example in FIG. 1. Fluids are stored in the chambers 29 by displacing sea water from the chambers to the exterior of the anchor members 28. In this regard the anchor members 28 may have an open bottom end or also be provided with exit and entry ports 40 for the displacement of sea water relative to the chambers 29 as well production fluids are pumped into and retrieved from the respective chambers. Suitable remotely controlled valving, not shown, may be interposed in the conduits 36 and 38 which can be provided for each cluster 26, for selectively controlling the filling and draining of fluids with respect to the chambers 29. The conduits 36 preferably extend into the interior of the caisson 24 and are connected to suitable risers leading to the platform 30.

Referring further to FIG. 1, the support column assembly 20 includes a vertically extending column comprising a plurality of column members generally designated by the numerals 42, 44 and 46. The total number of column members may vary according to the overall height of the column assembly 20 and for the example described above for use in water depths of about 2500 feet the column members 42, 44 and 46 each would be approximately 200 feet in length and 72 feet nominal outside diameter. The column segment 42 includes a conical transition portion 47 for forming a joint between the lower end of the column with the caisson member. Accordingly, a typical column assembly 20 for use in sea depths of about 2500 feet would be characterized by the base assembly 22, the transition column member 42, five column members 44, and a column member 46. The column member 46 is also adapted to include a unique mooring boom and gas flare support arm to be described in further detail herein.

Figure 2:
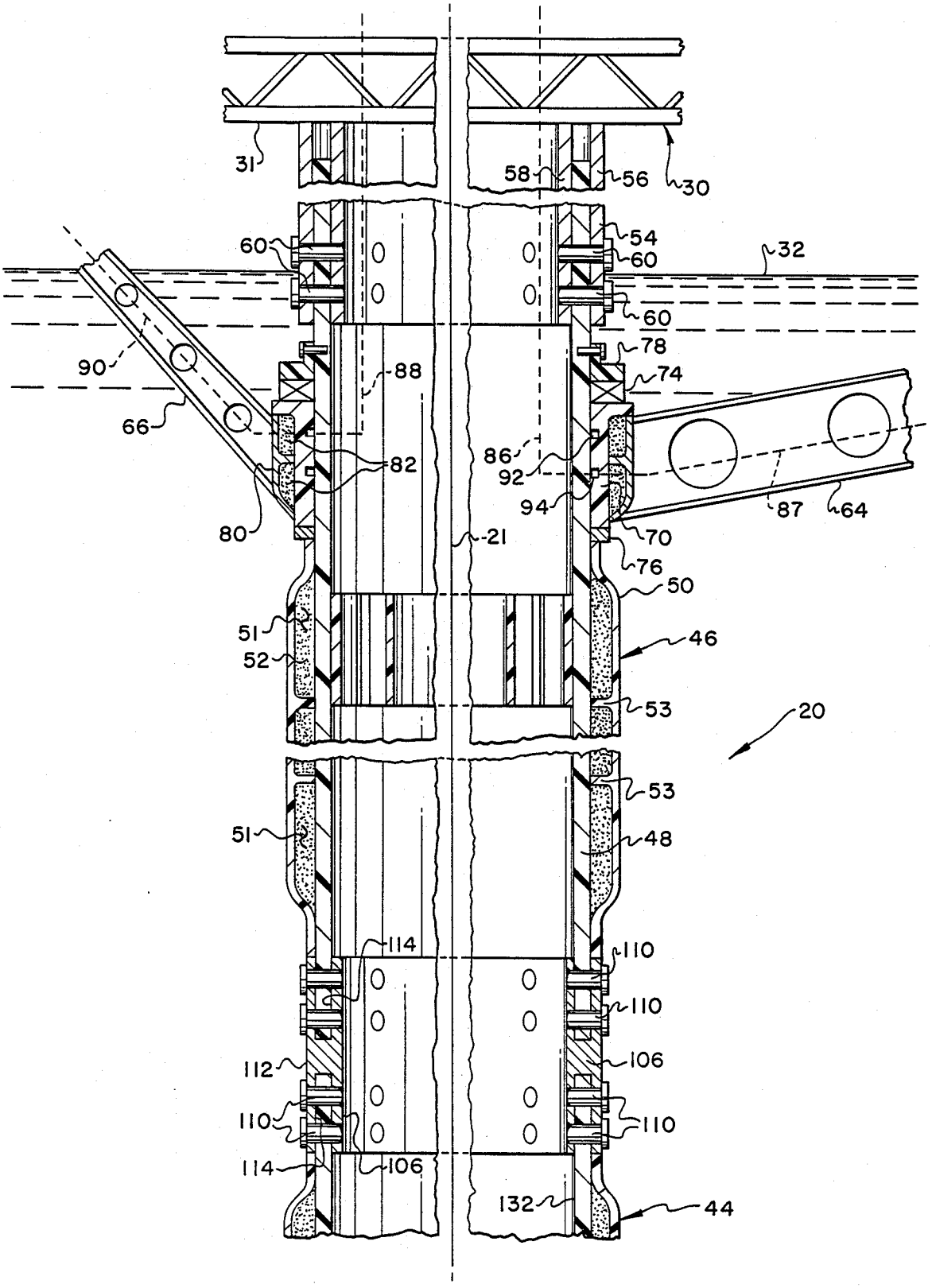
FIG. 2 is a vertical detail section view of an upper portion of the support column including the mooring swivel.

Referring to FIG. 2, the column member 46 includes structural features which are common to the column members 42 and 44 also, including an annular cylindrical load bearing wall 48 which is made up of a carbon or boron filament network embedded in a resin matrix similar to the structure described in my copending U.S. patent application Ser. No. 624,621, filed: June 26, 1984 now U.S. Pat. No. 4,634,314. This composite structure includes a mat of fine filaments of carbon, generally designated by the numeral 49 in FIG. 4, and which are helically wound in opposite directions with respect to the longitudinal central axis 21 of the column assembly and the respective column members and which may also be arranged longitudinally in the wall 48. The particular configuration of the helically wound and longitudinally extending filaments 49 may be determined in accordance with the overall strength requirements of the column members 42, 44 and 46.

It is contemplated that the nominal overall wall thickness of the composite wall 48 for the member 46, as well as for the corresponding composite walls of the members 42 and 44, may be in the range of about six to ten inches for a column having the overall dimensional and load support requirements described herein by way of example. At least a portion of the column member 46 is provided with means for providing a net positive or at least neutral buoyancy for the column member and comprising an outer cylindrical jacket 50 characterized by a shell like structure bonded to the outer surface of the wall 48 and enclosing annular spaces 51 between the wall 48 and the jacket 50 which may be filled with suitable material such as expanded plastic foam, generally designated by the numeral 52. The presence of the foam material 52 aids in resisting the collapse of the jacket 50 under hydrostatic water pressure at the greater depths of the column assembly 20 and aids in preventing the incursion of sea water into the spaces formed between the outer surface of the wall 48 and the inner surface of the wall of the jacket 50. The jacket 50 is preferably formed of a reinforced plastic construction such as an aramid or glass fiber reinforcement embedded in a polyester or epoxy matrix. Spaced apart load transmitting ribs 53 are adapted to aid in preventing collapse of the jacket 50 and to provide watertight bulkheads between adjacent spaces or chambers 51. The jacket 50 and the foam material 52 preferably provide for about 8% positive buoyancy of the members 42, 44 and 46 to reduce the effect of vertical column loading of the platform 30 which must be supported by the base assembly 22 and the lower ones of the column members.

Referring further to FIG. 2, the connection between the platform 30 and the column member 46 preferably comprises a generally cylindrical double walled depending sleeve, generally designated by the numeral 54, and including outer and inner sleeve members 56 and 58, respectively. Although the sleeve 54 is illustrated as a full cylindrical structure it may comprise circumferentially spaced cylindrical segments to reduce platform weight. The composite wall 48 extends into an annular slot formed between the sleeve members 56 and 58 and is secured to the sleeve 54 by a plurality of tight fitting pins 60. The pins 60 are typically arranged in two rows of approximately two hundred forty pins per row, each pin being of about 1.50 inches diameter and manufactured of high strength stainless steel. Only a representative number of pins 60 are illustrated in the interest of clarity and conciseness. For the 30,000 ton platform 30 described herein, the overall height of the support sleeve 54 is preferably about two hundred feet to place the bottom of the platform frame 31 about one hundred forty-five feet above the nominal sea surface 32.

The column member 46 is particularly adapted to support a unique free swiveling mooring boom, generally designated by the numeral 64 and a support arm 66 for a gas flare 68, FIG. 1. As illustrated in FIG. 1, the mooring boom 64 is connected at its distal end to a buoy 69 which in turn is provided with a mooring yoke 72 for mooring a tank ship 73 to the column assembly 20. The boom 64 and the flare support arm 66 are each secured to a swivel sleeve 70 which is disposed about the wall 48 of the column member 46 and is freely rotatable so that the tank ship 73 and the gas flare 68 will "weathervane" in accordance with prevailing wind directions to place the gas flare away from the tank ship under all operating conditions. The sleeve 70 is suitably supported for relatively free rotation about the central axis 21 of the support column 20, FIG. 2, and is retained on the column member 46 by suitable bearing means 74 and 76 and a retaining collar 78. The swivel sleeve 70 is also preferably provided with a corrosion and impact resistant outer jacket 80 for enclosing chambers filled with buoyancy material 82 in a manner similar to the arrangement to the jacket 50.

The arrangement of the mooring boom 64 is particularly advantageous in that, as shown in FIG. 2, a conduit 86 extends down through the column and by way of the swivel sleeve 70 to a conduit 87. The conduit 87 is supported on the boom 64, leads to the tanker mooring buoy 69 and is suitably coupled to a line 71, FIG. 1, at the buoy 69 for loading or off loading the tank ship 73. In like manner a gas conduit 88 extends down through the sleeve 54 and the interior of the column member 46 and leads to a conduit 90 extending along the flare support arm 66. In this regard the swivel sleeve 70 is preferably provided with means to assure fluid communication between the conduits 86 and 87 and the flare gas conduits 88 and 90, such means including annular passages 92 and 94, respectively. Further details of the respective conduits for handling fluids and flare gas between the platform 30 and the respective boom and arm members 64 and 66, inclusive of means for sealing the respective annular passages 92 and 94 from leakage of fluid, are not believed to be necessary to enable one to practice the present invention.

Figure 3:
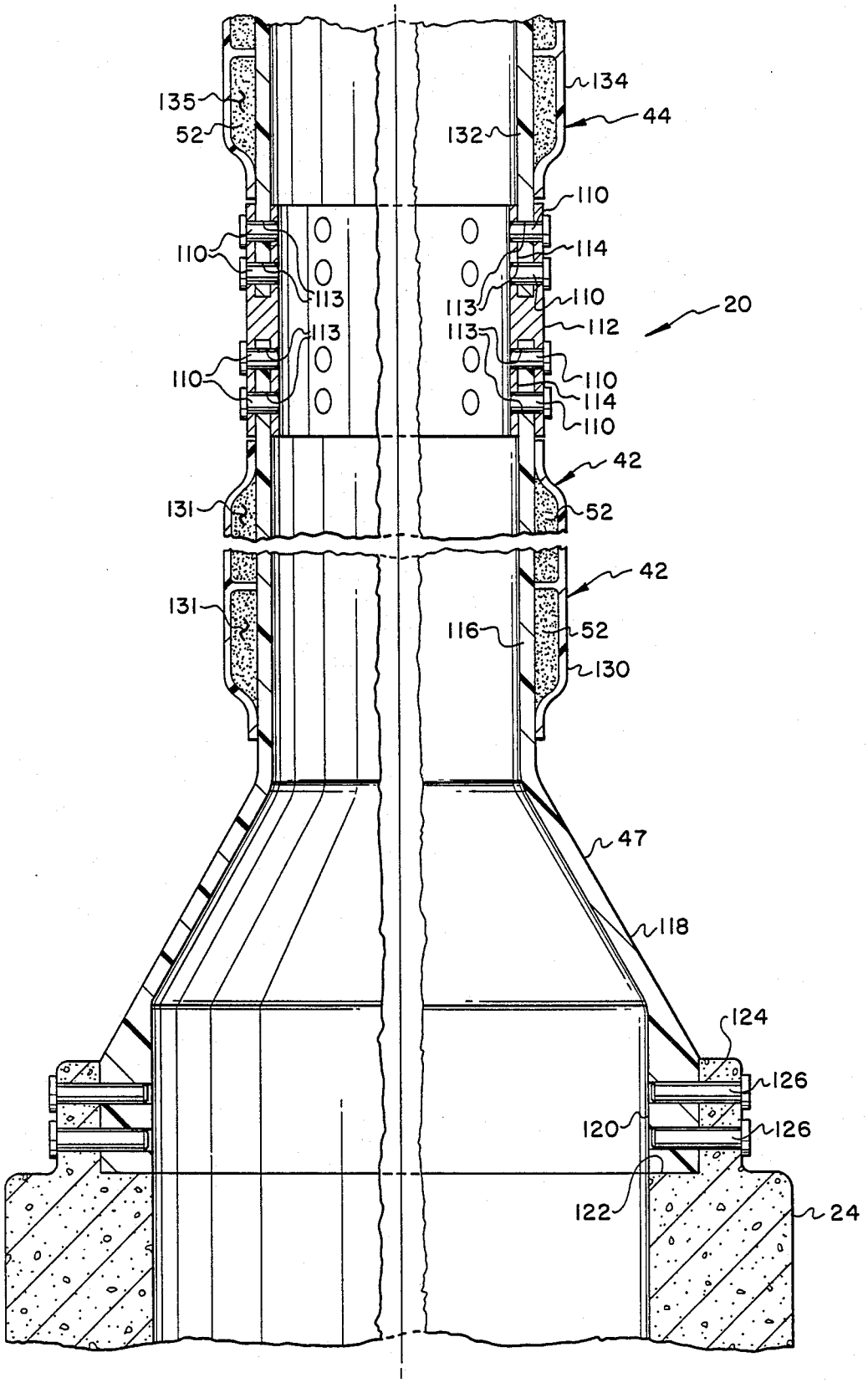
FIG. 3 is a vertical section view of a portion of one of the column members and the transition member to a reinforced concrete support base.

Referring further to FIG. 2 and also FIG. 3, the column members 42, 44 and 46 are interconnected to each other by coupling means including, as shown in FIG. 2, coupling members 112. Each of the coupling members 112 is characterized by a generally cylindrical central web portion 106 and opposed annular slots 114 for receiving an end of the composite wall 48, for example. Plural rows of radially projecting pins 110 are provided for securing the coupling members 112 to the ends of the column members 46 and 44, as illustrated. The column members 44, as well as the column member 42, may be interconnected by coupling member 112 whereby the loads imposed on the column members may be transmitted between each other through the coupling members and the pins 110 are provided in sufficient numbers to provide a suitable maximum stress in the composite walls and a factor of safety under the maximum loading imposed on the column assembly 20.

Referring to FIG. 3, the column member 42 includes a generally cylindrical composite wall section 116 integral with a frustoconical composite transition wall section 118. The wall sections 116 and 118 are also formed of plural windings of carbon or boron filaments 49, as shown for the composite wall of the column member 44, FIG. 4, and embedded in a suitable resin matrix. The lower end of the transition wall section 118 includes a generally cylindrical collar portion 120 which fits in a counterbore or recess 122 formed at the upper end of the caisson member 24. The caisson member 24 includes an upstanding peripheral rim 124 defining the recess 122 for receiving the collar portion 120 and whereby the column member 42 may be secured to the caisson member by radially projecting pins 126 similar to the pins 110. The column member 42 also includes a flotation jacket 130 comprising an aramid or glass fiber-resin composite shell and providing annular spaces 131 between the composite wall 116 and the jacket 130 which may be filled with low density plastic foam 52.

Figure 4:
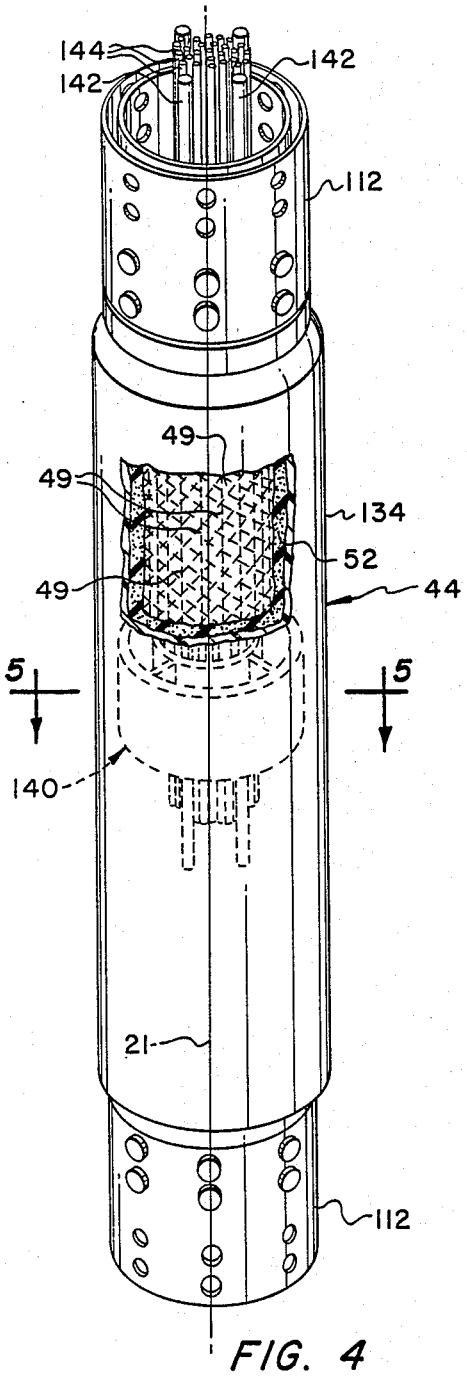
FIG. 4 is a perspective view, partially broken away, of one of the column members.
Figure 5:
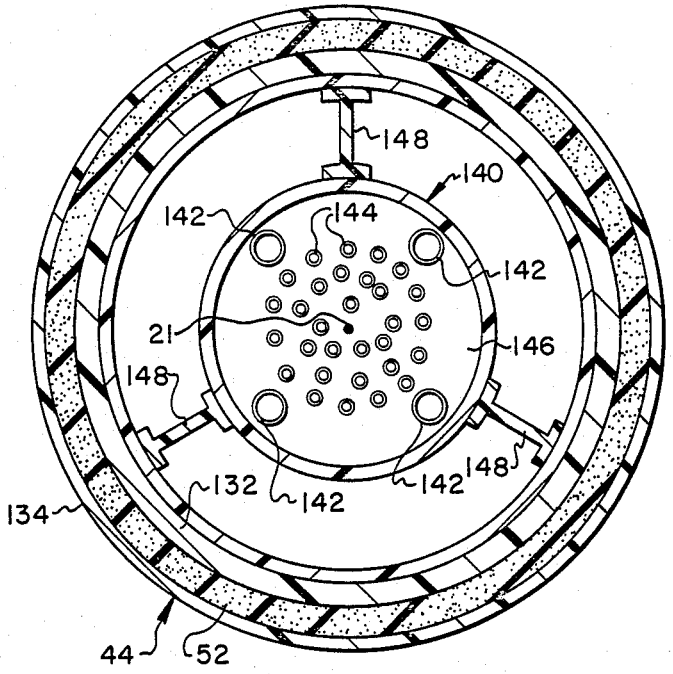
FIG. 5 is a transverse section view taken along the line 5—5 of FIG. 4.

Each of the column members 44 includes a cylindrical load bearing composite wall 132 which is suitably coupled at its opposite ends to coupling members 112 for transmitting, tensile, compressive and bending loads between adjacent column members. The column members 44 each also include an outer jacket 134 providing annular spaces 135 occupied by the buoyancy material 52. The composite wall 132 is, as illustrated in FIG. 4, is characterized by helically wound and longitudinally extending carbon or boron filaments 49 embedded in a resin matrix. As shown in FIGS. 4 and 5, by way of example, each of the column members 42, 44 and 46 is provided with suitable spaced apart guide and support webs, generally designated by the numeral 140, for supporting vertically extending conduits or risers 142 and 144. The risers 144 may comprise drilling and/or production risers for a plurality of wells being drilled or produced by the platform 30 and which extend through a platelike web section 146 of the web 140 and supported by radially extending arm portions 148. The riser support webs 140 are typically fabricated of filament wound reinforced plastic constructed similar to the composite walls 48, 116 and 132. The risers 142 and 144 themselves may be made in accordance with my teachings in the aforementioned copending patent application. The risers 142 are each typically connected to one of the conduits 36 for transferring fluids between the storage chambers 29 and the platform 30. The risers 144 each typically extend to a wellhead, not shown, on the seabed 34.

The caisson 24 may be provided with provided with suitable guide means, as will be described further herein, for directing the risers in angular direction with respect to the axis 21 at the seabed whereby directional drilling of wells may be carried out through the interior of the column assembly 20. The construction of the column support members 42, 44 and 46 may be carried out utilizing known techniques for the construction of filament wound cylindrical composite structural members and further including the method described in my aforementioned patent application. The construction of the caisson member 24 and the anchor members 28 may be carried out using known concrete slip form casting techniques, for example, at an onshore site or in a suitable drydock type facility.

In a preferred method of assembling the support column 20, the respective column members 42, 44 and 46, having a net positive buoyancy, may be floated in a generally horizontal position to the vicinity of the site at which the support column 20 is to be installed. Upon reaching the installation site, the column members 42, 44 and 46 may be assembled to each other by rotating the column members while they are floating in a generally horizontal position so that assembly operations may be carried out above the water surface. Such operations would typically comprise preassembling a coupling member 112 to one or both ends of selected ones of the column members 42 or 44 and then final assembling to the other column members at the installation site by installing the pins 110 into the coupling members 112 after predrilling suitable pin receiving holes 113, for example, FIG. 3, in one or the other of the composite walls 116 and 132. The pins 110 are preferably secured in their assembled positions by an epoxy type coating to seal and secure the joint formed in part by the pins.

The caisson member 24 may be floated out to the installation site utilizing temporary flotation bladders or the like and assembled to the column member 42 in a manner similar to that just described for assembling the column members 42, 44 and 46 to each other. The anchor members 28, which are positively buoyant when the chambers 29 are evacuated, may be floated out under their own positive buoyancy by closing the ports 40 with the chambers 29 evacuated utilizing conventional valving. If the bottom ends of the chambers 29 are open they may be plugged with temporary inflatable flotation bladders, not shown. The anchor members 28 may be suitably joined to each other in the clusters 26 by connection means, not shown, and the clusters 26 then joined by similar connection means, not shown, to the caisson member 24.

After preparation of the site on the seabed 34, completion of assembly of the column members 42, 44 and 46 to each other and to the base assembly 22, controlled flooding of the chambers 29 may be carried out to tilt the support column assembly 20 into the vertical position and submerge it to a resting point on the seabed 34. The platform 30 may then be floated out on suitable work barges and hoisted into position on top of the support column assembly 20 utilizing conventional equipment and techniques. The boom swivel collar 70 would typically be installed, of course, before installation of the platform 30. Once the platform 30 has been installed and rigged for operation installation of the risers 142 and 144 may be carried out from the platform using known techniques as well as those described in the aforementioned patent application.

Production of hydrocarbon fluids from the apparatus comprising the support column assembly 20 and the platform 30 may be carried out in accordance with generally conventional techniques. Fluids produced by the apparatus may be off loaded directly to the tank ship 73 which is moored in a convenient manner by the system including the mooring boom 64, the mooring buoy 69 and the yoke assembly 72. All of the these components may be constructed as filament wound composite structures similar to that described for the column support members 42, 44 and 46. During periods of inclement weather which would preclude tank ship loading, production of fluids may be continued uninterrupted by storage of produced fluids in the chambers 29 of the anchor members 28. These operations may be carried out between tanker loading operations, of course, at any time. Bending stresses imposed on the column support assembly 20 by the tank ship 73 may be moderated or reduced by use of tank ship propulsion to reduce or eliminate any lateral loads on the support column assembly 20 itself.

Referring now to FIGS. 8 through 11, an alternate embodiment of a support column assembly in accordance with the present invention is illustrated and generally designated by the numeral 160. The support column assembly 160 includes the clusters 26 of anchor members 28 resting on the seabed 34 in the same manner as the support column assembly 20 and secured to a central caisson member 162 similar to the caisson member 24. The support column assembly 160 includes a plurality of vertically extending end to end connected column members **164, 166*a* and 166*b* which are of unique construction and are advantageously adapted to have a high degree of stiffness in bending but also be capable of supporting substantial vertical column loading such as that imposed on the column assembly by a fixed drilling and/or production platform 168. The platform 168 includes a vertically depending cylindrical support collar 170, see FIG. 10 also, similar to the support collar 54 and having concentric inner and outer sleeve portions 172 and 174. A generally horizontally extending annular web 175 is interposed between the sleeves 172 and 174 and is disposed in load transfer relationship to the upper end of the column member 166*a*. The platform 168 includes a horizontal deck structure 169 and a conventional drilling and/or workover derrick 171** thereon.

Each of the column members **166*a* and 166*b* is characterized by a unique combination of an outer cylindrical wall 176 which is constructed of helically wound and longitudinally extending filaments of carbon, boron or similar high strength filamentary materials embedded in a resin matrix and virtually of identical construction to that of the composite walls 132 and 48 of the respective column members 44 and 46. However, the composite walls 176 are each disposed around a reinforced concrete cylinder 178. In fact, the composite wall 176 may be formed using the reinforced concrete cylinder 178 as a mandrel on which the filaments are wound during the construction of the wall 176. The composite construction of the column members 164, 166*a* and 166*b* including the outer carbon or boron fiber-resin matrix walls and the inner reinforced concrete cylinders, provides a superior column assembly for applications such as the support of a vertical or longitudinal load while also being of sufficient stiffness to withstand lateral loading due to wind, current and wave action which can be imposed on the support column 160 in the application illustrated in FIG. 8. Accordingly, the column members 164, 166*a* and 166*b* are adapted such that the distal ends of the inner reinforced concrete cylinders 178, such as the distal end 180 illustrated in FIG. 10 and the abutting end faces 188, FIG. 9, are in load bearing engagement with the platform 168 and with each other, respectively for transferring the static weight load on the column directly to the caisson member 162**.

Figure 9:
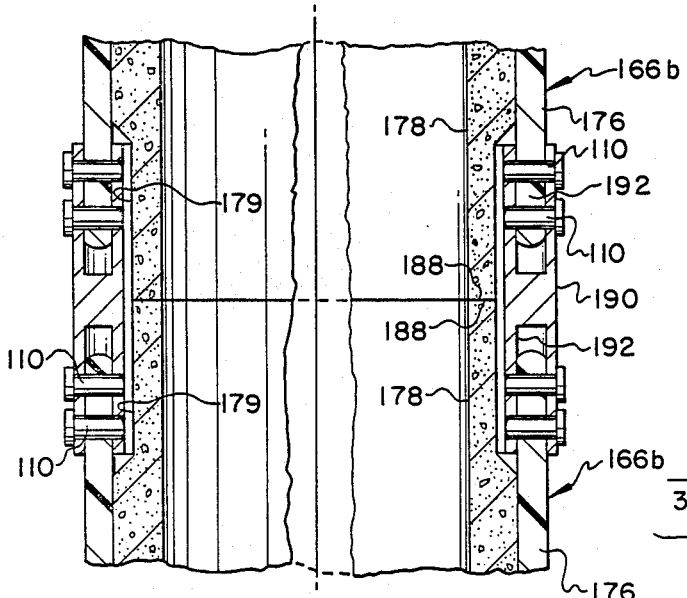
FIG. 9 is a detail section view taken along the line 9—9 of FIG. 8.
Figure 10:
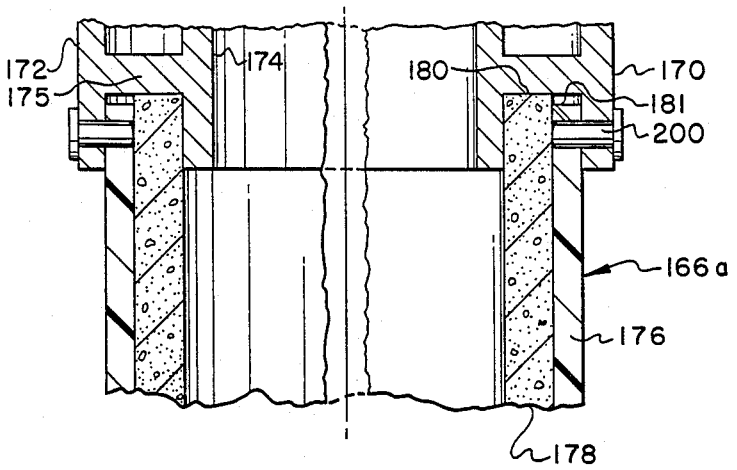
FIG. 10 is a detail section view taken along the line 10—10 of FIG. 8.

As shown in FIG. 9, a typical joint between adjacent column members 166 provides for the reinforced concrete cylinders 178 to be in end to end abutting engagement across the transverse end faces 188, as illustrated, so that vertical compressive loads may be transmitted between the platform 168 and the caisson member 162 substantially entirely through the reinforced concrete cylinder portions of the column members **164, 166*a* and 166*b*. The column members 164, 166*a* and 166*b* are interconnected as illustrated in FIG. 9 by coupling members 190 which have opposed annular grooves or recesses 192, respectively, for receiving the opposed distal ends of the composite walls 176, for example, for each of the column members 166*a* and 166*b*. The coupling members 190 are interconnected with the composite walls 176 by plural rows of radially projecting pins 110 in the same manner as the composite walls of the column members 42, 44 and 46 are interconnected with their respective coupling members. Accordingly, the column members 164, 166*a* and 166*b* are adapted to utilize the composite walls 176 in conjunction with the reinforced concrete cylinders 178 to withstand substantial lateral bending loads while the concrete cylinders 178 sustain essentially all of the compressive loading due to the weight of the platform 168** and any vertical drillstem or riser loads.

Figure 11:
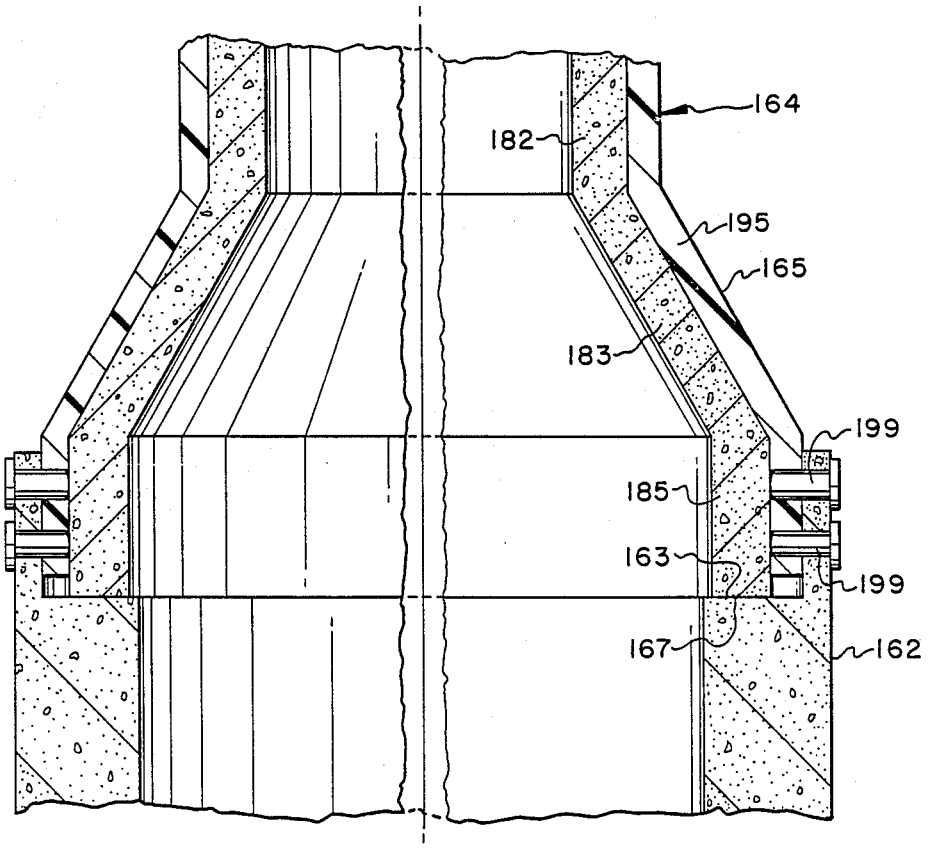
FIG. 11 is a detail section view taken along the line 11—11 of FIG. 8.

As illustrated in FIG. 11, the column member 164 includes a somewhat frustoconical transition portion 165 which also includes a reinforced concrete cylinder 182 having a transition section 183, 185 and a lower transverse end face 167 which is in abutting and load transferring engagement with a transverse wall 163 of the caisson member 162 whereby the vertical compressive load on the column assembly is transferred to the caisson member. The column member 164 is secured to the caisson member 162 through an outer composite wall 195 which is fabricated in the same manner as the composite walls 116 and 176, for example. The column member 164 is preferably secured to the caisson member 162 by plural rows of connecting pins 199 similar to the pins 126 but which project only through the composite wall 195 or at least are not in load bearing engagement with the inner reinforced concrete wall of the column member 164. The upper end of the column member 164 is joined to the lower end of a column member **166*b* by a coupling member 190 in the same manner as illustrated in FIG. 9 for the connection between two column members 166*b*. As shown by example in FIG. 9, each of the reinforced concrete walls 178 is inclusive of an annular recess 179 on at least one end thereof so that vertical compressive loads are not transmitted through the composite walls 176 but are transferred between the reinforced concrete walls 178 and 182 vertically downward to the caisson member 162 and the anchor clusters 26**.

The column members 164, 166*a* and 166*b* may each be provided with buoyancy structure similar to the buoyancy providing structure described herein for the column members 42, 44 and 46. The installation of the column assembly 160 may be similar to that described above for the column assembly 20. Upon installation of the platform 168 onto the column member 166*a* the platform is secured to the column member by radially projecting connecting pins 200, FIG. 10, extending into the composite wall 176 and suitably secured thereto by a force fit relationship. However, the pins 200 are installed after the platform 168 is assembled to the column member 166*a* and the weight of the platform is transferred through the reinforced concrete cylinders extending between the platform 168 and the caisson 162. The overall dimensions for the column members 164, 166*a* and 166*b* are similar to those given hereinabove for the column members 42, 44 and 46. Typical wall thickness for the reinforced concrete cylinders 178 and 182 should be on the order of 8.0 inches to 10.0 inches, based on column member dimensions corresponding to those of the column members 42, 44 and 46, and depending on the actual weight of the platform 168, of course.

Figure 8:
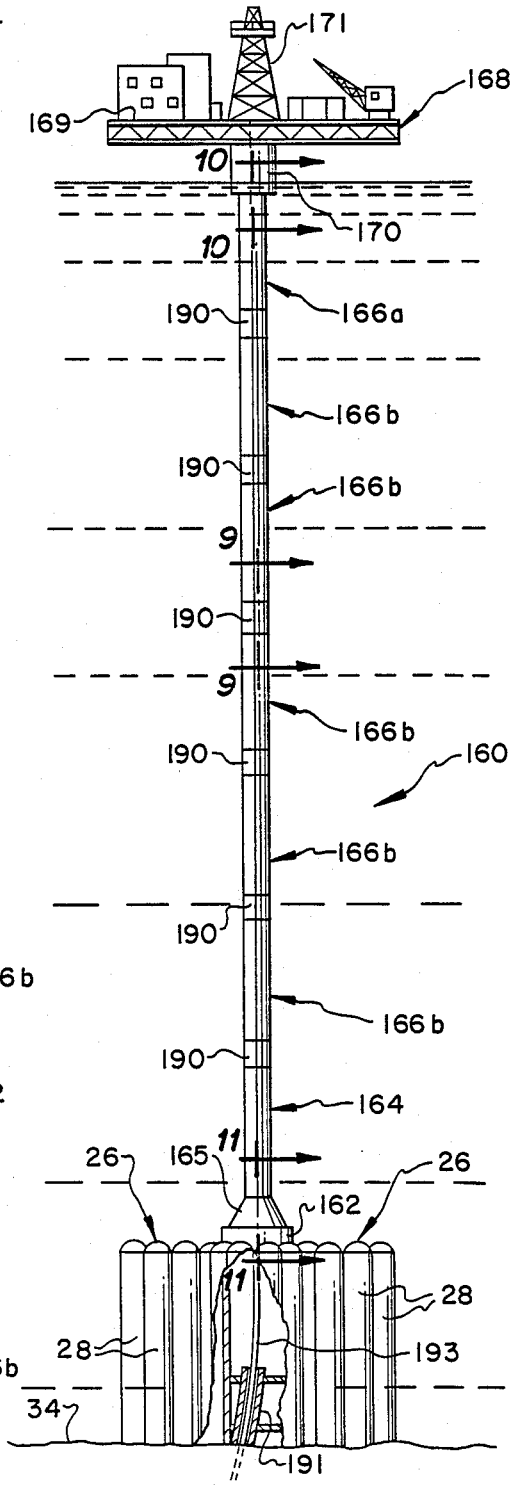
FIG. 8 is an elevation of another alternate embodiment of the present invention.

FIG. 8 also illustrates a feature common to all of the column assembly embodiments of the present invention. By way of example, the caisson 162 is adapted to include one or more directional drilling guides 191, one shown, disposed therein for guiding a drill stem 193 which depends from the derrick 171, whereby wells may be drilled at different directional attitudes with relative ease.

Figure 6:
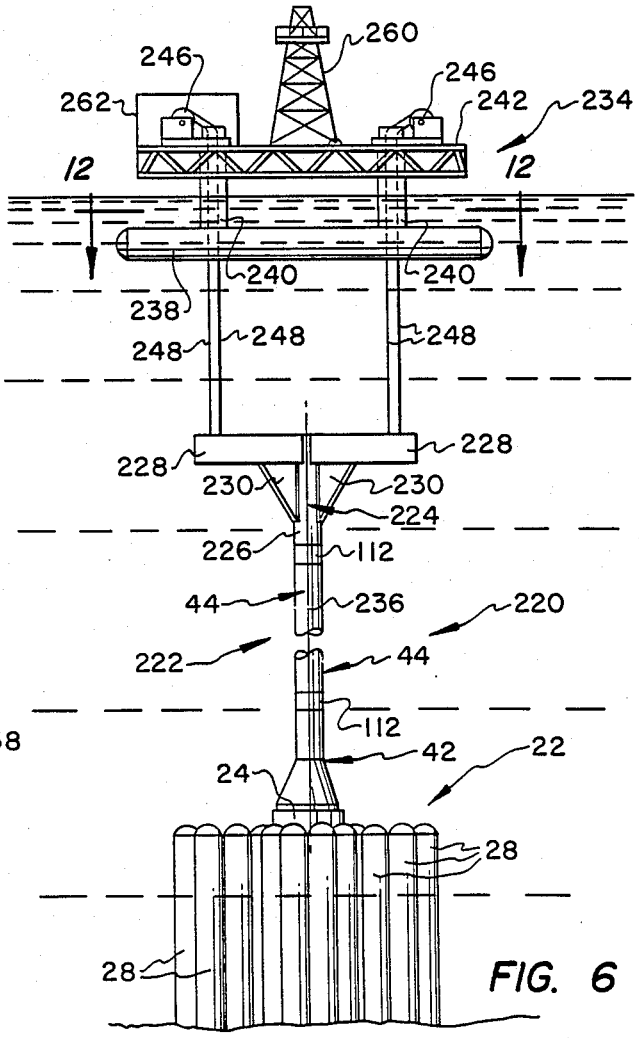
FIG. 6 is an elevation of one alternate embodiment of a support column assembly for anchoring a submersible production platform in accordance with the present invention.
Figure 12:
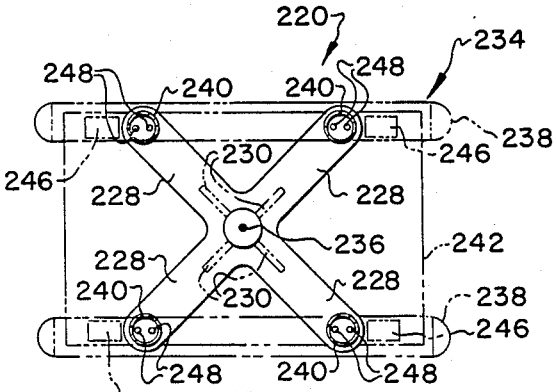
FIG. 12 is a section view taken generally along line 12—12 of FIG. 6.
Figure 7:
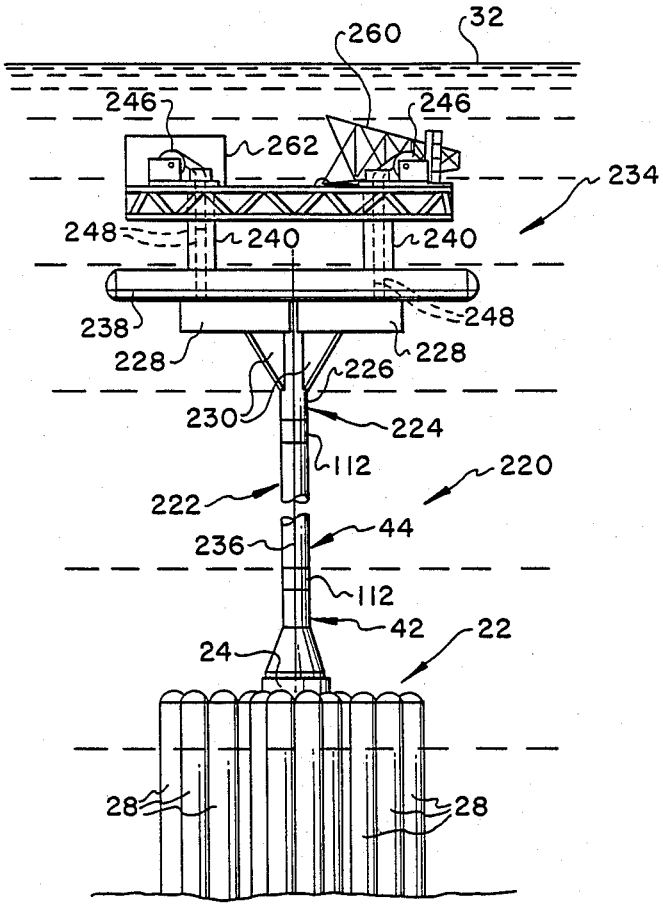
FIG. 7 is a view similar to FIG. 6 showing the submersible platform winched down below the sea surface.

Referring now to FIGS. 6, 7 and 12, another embodiment of an apparatus comprising a support column and platform assembly for development and production of offshore hydrocarbon deposits is illustrated and generally designated by the numeral 220. The apparatus 220 includes a support column assembly 222, similar in some respects to the support column assembly 20, and including a modified column member 224 in place of the column member 46. The support column 222 may, for example, include the base assembly 22, the column member 42 and a plurality of column members 44 together with the upper column member 224. For installation in water of about 2500 feet depth the apparatus 220 would include four column members 44 connected end to end by coupling members 112 and also connected to the column member 42 by a coupling member 112 as illustrated for the support column assembly 20. The column member 224 includes a vertically depending cylindrical portion 226 constructed similar to the column members 44 and four horizontally projecting beam portions 228, see FIG. 12, projecting from the column portion 226 to form a right cross configuration and inclusive of gusset members 230.

The support column assembly 222 is adapted to provide for anchoring a submersible drilling or production vessel 234 in position generally centrally disposed with respect to the longitudinal vertical axis 236 of the support column assembly. The vessel 234 is similar to a column stabilized semi submersible vessel and includes a pair of longitudinal spaced apart ballastable hulls 238 supporting corner columns 240 which in turn support a platform deck 242. The platform deck 242 also supports a plurality of drum type cable winches 246 which are spaced apart and are adapted to be connected to a series of anchor cables 248 which are reaved through suitable fairleads, not shown, and extend vertically downward through the hollow corner columns 240. The anchor cables 248 are secured at their lower ends to the respective beams 228. By operation of the winches 246 the vessel 234 may be winched below the surface 32 of the sea in the event of storms or other heavy sea conditions. In the position illustrated in FIG. 7 the vessel 234 remains secured to the support column assembly 222 at a relatively safe distance below the mean surface of the sea and out of a position in which the vessel would be subject to severe wind or wave action. Of course, the cables 248 are preferably formed of high strength laid or braided filaments of aramid, carbon or boron and the beam members 228 may also be fabricated integral with the column support portion 226 and formed of wound carbon or boron fibers embedded in a resin matrix.

The vessel 234 includes a folding work derrick 260 and watertight enclosure 262 adapted to be submerged to protect on board equipment when the vessel is in the condition illustrated in FIG. 7. The winches 246 may be remote controlled and adapted for submerged operation to raise and lower the vessel 234. Ballasting and deballasting of the hulls 238 may be carried out, also, by remote control or from an onboard habitat, not shown, which is also capable of submarine operation. By controlled ballasting of the hulls 238 the support members 42, 44 and 224 may actually remain in tension under virtually all operating conditions so that compressive static loading on the column assembly is eliminated or at least maintained at insignificant levels. Assembly of the support column 222 may be carried out in generally the same manner as previously described for the support column assemblies 20 and 160.

Although preferred embodiments of the invention have been described herein in detail, those skilled in the art will recognize that various substitutions and modifications may be made to the specific embodiments described without departing from the scope and spirit of the invention as recited in the appended claims.

What I claim is:

1. A support column assembly for an offshore drilling and/or production comprising:

anchor means for anchoring said column assembly on the seabed;

an elongated cylindrical support column including at least one generally cylindrical column member having a cylindrical wall formed of a composite of elongated filaments of at least one of carbon and boron bonded in a resin matrix, said support column including a plurality of said column members coupled end to end by coupling means at opposite ends of said column members, said coupling means including a plurality of radially project pins for coupling said composite wall to a coupling member interposed between said column members, respectively;

and means for connecting said column to a platform for transmitting platform loads between said platform and said anchor means.

2. The assembly set forth in claim 1 wherein:

said coupling member includes a cylindrical sleeve having annular recess means for receiving cylindrical end portions of said composite walls of said column members, respectively.

3. The assembly set forth in claim 1 wherein:

said column members each include a cylindrical concrete wall disposed in sleeved relationship to and coextensive with said composite walls of said column members for transmitting compressive stresses imposed on said column between said platform and said anchor means.

4. The assembly set forth in claim 3 wherein:

said platform includes collar means for securing said platform to the upper end of said column and for transferring the weight of said platform to said concrete wall.

5. The assembly set forth in claim 1 or 3 wherein:

said anchor means comprises a generally cylindrical caisson member including means for supporting said column at an upper end of said caisson member, and a plurality of anchor members clustered around said caisson member for stabilizing said caisson member and for distributing the bearing pressure of said assembly on the seabed.

6. The assembly set forth in claim 5 wherein:

said anchor members comprise a plurality of elongated concrete cylinders, at least selected ones of said cylinders including interior chamber means for storing fluids for transfer between said anchor members and said platform.

7. An offshore drilling and/or production platform system comprising:

anchor means for anchoring said platform system on the seabed;

an elongated cylindrical support column including a plurality of end to end connected generally cylindrical column members, each of said column members having a cylindrical wall formed of a composite of elongated filaments of one of carbon and boron bonded in a resin matrix;

coupling means at opposite ends of said column members, respectively, said coupling means including a plurality of radially projecting pins for coupling said composite wall to a coupling member interposed between said column members, respectively;

at least the uppermost column member being disposed below the sea surface and being adapted to be secured to a plurality of spaced apart anchor cables, said anchor cables extending upwardly toward the sea surface;

a submersible vessel having buoyant hull means and means connected to said anchor cable means, respectively, for anchoring said vessel to said column; and means for submerging said vessel while connected to said anchor cable means and said column to remove said vessel from exposure to wind and wave action on the sea.

8. The system set forth in claim 7 wherein:

said coupling members include a cylindrical sleeve having annular recess means for receiving cylindrical end portions of said composite walls of said column members, respectively.

9. A support column assembly for an offshore drilling and/or production platform comprising:

anchor means for anchoring said column assembly on the seabed;

an elongated cylindrical support column including at least one generally cylindrical column member having a cylindrical wall formed of a composite of elongated filaments of a least one carbon and boron bonded in a resin matrix;

means for connecting said column to a platform for transmitting platform loads between said platform and said anchor means;

and said column including a member adapted to be connected to plural anchor cable means, said platform disposed on a submersible vessel having buoyant hull means and means connected to said anchor cable means, respectively, and said assembly including means for submerging said vessel while connected to said anchor cable means and said column to remove said vessel from exposure to wind and wave action on the sea.

10. A support column assembly for an offshore drilling and/or production platform comprising:

anchor means for anchoring said column assembly on the seabed;

an elongated cylindrical support column including at least one generally cylindrical member having a cylindrical wall formed of a composite of elongated filaments of at least one carbon and boron bonded in a resin matrix;

mooring boom means connected to said column and pivotable about the central longitudinal axis of said column for mooring a tankship and the like to said column, including an arm operably connected to said boom and projecting generally opposite said boom with respect to said axis and support a gas flare;

and means for connecting said column to a platform for transmitting platform loads between said platform and said anchor means.

11. A platform support structure for an offshore platform for producing hydrocarbon fluids, said support structure comprising:

an anchor base including a central member disposed on the seabed;

an elongated vertically extending column connected at its lower end to said base, said column including a plurality of end to end connected column members, each of said column members comprising an elongated cylinder having a cylindrical load bearing composite wall formed of filaments of one of carbon and boron in a resin matrix, the upper end of said column disposed below the sea surface; and, a platform supported on spaced apart submersible hulls, said platform connected to said upper end of said column by spaced apart cable means extending between said platform and said upper end of said column for anchoring said platform in position above said column;

means for connecting said column members end to end; and means for connecting said column at its upper end to platform means disposed above the sea surface.

12. A support column assembly for an offshore drilling and/or production platform comprising:

anchor means for anchoring said column assembly on the seabed;

an elongated cylindrical support column including a plurality of generally cylindrical column members coupled end to end, each of said column members having a cylindrical wall formed of a composite of elongated filaments of one carbon and boron bonded in a resin matrix, said column including collar means pivotally mounted thereon and connected to said boom, and said means for transferring fluid includes means for transferring fluid through said collar means between a conduit leading to said tankship and a conduit leading to said platform, means for connecting said column to a platform for transmitting platform loads between said platform and said anchor means;

mooring boom means connected to said column and freely pivotable about said column for mooring a tankship and the like to said column for transferring fluids through said beam between said platform and said tankship, an arm operably connected to said collar means and projecting generally opposite said boom with respect to said column and supporting a gas flare.

* * * * *